US010450703B2

(12) United States Patent
Shannon et al.

(10) Patent No.: US 10,450,703 B2
(45) Date of Patent: Oct. 22, 2019

(54) SOFT TISSUE COMPRISING SYNTHETIC FIBERS

(71) Applicant: Kimberly-Clark Worldwide, Inc., Neenah, WI (US)

(72) Inventors: Thomas Gerard Shannon, Neenah, WI (US); Bo Shi, Neenah, WI (US); Jeffrey James Timm, Menasha, WI (US); Abigail Joy Mitchell, Appleton, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 261 days.

(21) Appl. No.: 15/544,141

(22) PCT Filed: Feb. 22, 2017

(86) PCT No.: PCT/US2017/018832
§ 371 (c)(1),
(2) Date: Jul. 17, 2017

(87) PCT Pub. No.: WO2018/156111
PCT Pub. Date: Aug. 30, 2018

(65) Prior Publication Data

US 2018/0334778 A1 Nov. 22, 2018

(51) Int. Cl.
*D21H 27/00* (2006.01)
*D21H 27/30* (2006.01)
(Continued)

(52) U.S. Cl.
CPC ..... *D21H 5/00* (2013.01); *D21F 11/14* (2013.01); *D21H 13/24* (2013.01);
(Continued)

(58) Field of Classification Search
CPC .... D21H 27/002; D21H 27/005; D21H 27/38; D21H 27/30; D21H 13/24; D21H 5/00;
(Continued)

(56) References Cited

U.S. PATENT DOCUMENTS 3,057,772 A 10/1962 Magill, Jr. et al.
3,905,863 A 9/1975 Ayers
(Continued)

FOREIGN PATENT DOCUMENTS

EP 0 851 062 A2 7/1998
WO WO 2013/116066 A1 8/2013
(Continued)

OTHER PUBLICATIONS

CFF® Fibrillated Fiber, available at Internet web page "https://web.archive.org/web/20160608223654/http://eftfibers.com/doc/d3.pdf", Jun. 6, 2016, 5 pages.

*Primary Examiner* — Jose A Fortuna
(74) *Attorney, Agent, or Firm* — Kimberly-Clark Worldwide, Inc.

(57) ABSTRACT

The present application provides a tissue product comprising at least about 10 weight percent high coarseness fibers, from about 1.0 to about 10 weight percent synthetic fibers and less than about 10 weight percent long, low-coarseness cellulosic fibers. The high coarseness fibers may be cellulosic fibers having an average fiber length greater than about 2.0 mm and a coarseness greater than 17 mg/100 m, such as Southern softwood kraft pulp fibers (SSWK) derived from a pine in the *Pinus* subgenus, and the synthetic fiber is a non-cellulosic, thermoplastic fiber such as non-fibrillated polyethylene terephthalate (PET) fibers. In certain embodiments the tissue products may be substantially free from long, low coarseness cellulosic fibers, yet provide satisfactory strength, such as a geometric mean tensile from about 500
(Continued)

Figure 1:
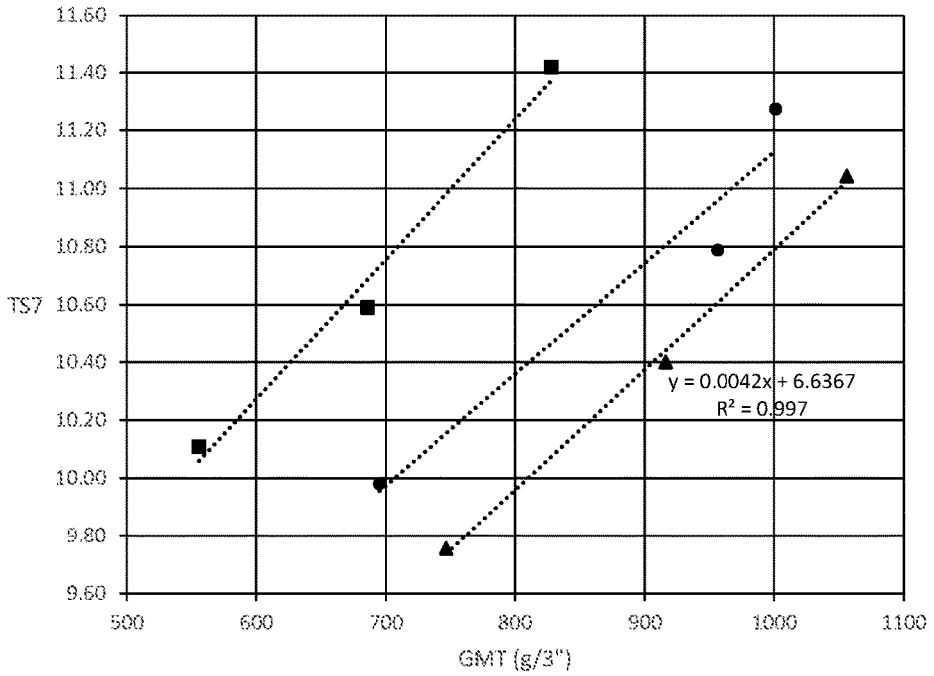

to about 1,200 g/3", and softness, such as a TS7 less than about 11.0.

17 Claims, 2 Drawing Sheets

(51) Int. Cl.
*D21H 27/38* (2006.01)
*D21H 13/24* (2006.01)
*D21F 11/14* (2006.01)

(52) U.S. Cl.
CPC ..... *D21H 27/002* (2013.01); *D21H 27/005* (2013.01); *D21H 27/30* (2013.01); *D21H 27/38* (2013.01)

(58) Field of Classification Search
CPC ..... D21H 27/42; B32B 2262/067; B32B 2307/54; B32B 2262/0223; B32B 2262/0253; B32B 2262/0276; B32B 2262/14; D21F 11/14; A47K 10/16; A47L 13/16; D04H 1/425; Y10T 428/24612
See application file for complete search history.

(56) References Cited

U.S. PATENT DOCUMENTS 4,007,083 A 2/1977 Ring et al.
5,049,235 A 9/1991 Barcus et al.
5,320,710 A 6/1994 Reeves et al.
5,529,665 A 6/1996 Kaun
5,679,218 A 10/1997 Vinson et al.
5,785,813 A 7/1998 Smith et al.
5,935,880 A 8/1999 Wang et al.
6,277,241 B1 8/2001 Merker et al.
6,861,380 B2 3/2005 Garnier et al.
7,718,036 B2 5/2010 Sumnicht et al.
7,749,356 B2 7/2010 Runge et al.
7,972,986 B2 7/2011 Barnholtz et al.
8,057,636 B2 11/2011 Vinson et al.
8,133,353 B2 3/2012 Blanz et al.
8,187,421 B2 5/2012 Sumnicht et al.
8,444,811 B2 5/2013 Dyer et al.
8,513,147 B2 8/2013 Gupta et al.
8,673,116 B2 3/2014 Konishi et al.
8,702,905 B1 4/2014 Hermans et al.
8,778,505 B2 7/2014 Shannon
8,864,945 B2 10/2014 Miller et al.
9,005,738 B2 * 4/2015 Baker ..... A47L 13/16 428/172
9,074,324 B2 7/2015 Shannon et al.
9,267,240 B2 2/2016 Lee et al.
9,282,870 B2 3/2016 Sumnicht et al.
9,314,142 B2 * 4/2016 Baker ..... A47L 13/16
9,661,974 B2 * 5/2017 Baker ..... A47L 13/16
10,045,677 B2 * 8/2018 Baker ..... A47L 13/16
10,301,779 B2 * 5/2019 Sealey, II ..... D21F 11/145
2003/0098135 A1 5/2003 Ross et al.
2004/0087237 A1 5/2004 Garnier et al.
2004/0154763 A1 8/2004 Polat et al.
2007/0137808 A1 6/2007 Lostocco et al.
2007/0144697 A1 6/2007 Dyer et al.
2007/0187055 A1 * 8/2007 Manifold ..... D21B 1/00 162/125
2007/0232178 A1 10/2007 Polat et al.
2007/0232180 A1 10/2007 Polat et al.
2007/0284069 A1 12/2007 Dyer et al.
2008/0014428 A1 1/2008 Vinson et al.
2009/0022983 A1 1/2009 Cabell et al.
2009/0036015 A1 2/2009 Nhan et al.
2011/0104493 A1 5/2011 Barnholtz et al.
2011/0220310 A1 9/2011 Polat et al.
2012/0021178 A1 1/2012 Miller et al.
2012/0302119 A1 11/2012 Clark et al.
2013/0029105 A1 1/2013 Miller et al.
2013/0071655 A1 * 3/2013 Zwick ..... D21H 27/002 428/340
2013/0199741 A1 8/2013 Stage et al.
2013/0216789 A1 8/2013 Kraus et al.
2013/0288556 A1 10/2013 Moore et al.
2014/0096924 A1 * 4/2014 Rekoske ..... D21H 27/002 162/111
2014/0311694 A1 10/2014 Clark et al.
2014/0311695 A1 10/2014 Clark et al.
2015/0114580 A1 4/2015 McKee et al.
2015/0240426 A1 8/2015 Hermans et al.
2015/0330029 A1 * 11/2015 Ramaratnam ..... D21H 27/40 15/104.93
2016/0145809 A1 * 5/2016 Hermans ..... A47K 10/16 162/111
2016/0145810 A1 5/2016 Miller, IV et al.
2017/0314207 A1 * 11/2017 Sealey, II ..... D21F 11/145
2018/0142419 A1 * 5/2018 Rouse ..... D21H 27/005
2018/0142422 A1 5/2018 Baum et al.
2018/0334778 A1 * 11/2018 Shannon ..... D21F 11/14
2018/0344120 A1 * 12/2018 Baker ..... A47L 13/16
2019/0161916 A1 * 5/2019 Shannon ..... D21H 27/005
2019/0169798 A1 * 6/2019 Rouse ..... D21H 27/005

FOREIGN PATENT DOCUMENTS

WO WO 2016/122477 A1 8/2016
WO WO 2016/134256 A1 8/2016
WO WO18063240 A1 4/2018
WO WO-2018156111 A1 * 8/2018 ..... D21F 11/14

* cited by examiner

SOFT TISSUE COMPRISING SYNTHETIC FIBERS

BACKGROUND OF THE DISCLOSURE

Papermakers, and in particular tissue paper makers, have long sought to balance the strength and softness of paper products by treating or altering the papermaking furnish. For example, one common practice in the manufacture of tissue products is to provide two furnishes (or sources) of wood pulp fiber. Sometimes, a two-furnish system is used in which the first furnish comprises a wood pulp fiber having a relatively short fiber length, such as a hardwood kraft pulp fiber, and the second furnish is made of wood pulp fiber having a relatively long fiber length, such as softwood kraft pulp fiber. The short fiber furnish may be used to provide the finished product with a softer handfeel, while the long fiber furnish may be used to provide the finished product with strength.

While surface softness in tissue products is an important attribute, a second element in the overall softness is stiffness. Stiffness can be measured from the tensile slope of stress-strain tensile curve. The lower the slope the lower the stiffness and the better overall softness the product will display. Stiffness and tensile strength are positively correlated, however at a given tensile strength shorter fibers will display a greater stiffness than long fibers. While not wishing to be bound by theory, it is believed that this behavior is due to the higher number of hydrogen bonds required to produce a product of a given tensile strength with short fibers than with long fibers. Thus, easily collapsible, low coarseness long fibers, such as those provided by Northern Softwood Kraft (NSWK) fibers typically supply the best combination of durability and softness in tissue products when those fibers are used in combination with hardwood Kraft fibers such as *Eucalyptus* hardwood Kraft fibers. While Northern Softwood Kraft Fibers have a higher coarseness than *Eucalyptus* fibers their small cell wall thickness relative to lumen diameter combined with their long length makes them the ideal candidate for optimizing durability and softness in tissue.

Unfortunately, supply of NSWK is under significant pressure both economically and environmentally. As such, prices of NSWK fibers have escalated significantly creating a need to find alternatives to optimize softness and strength in tissue products. Another type of softwood fiber is Southern Softwood Kraft (SSWK) widely used in fluff pulp containing absorbent products such as diapers, feminine care absorbent products and incontinence products. Unfortunately while not under the same supply and environmental pressures as NSWK, fibers from SSWK are too coarse for tissue products and are unsuitable for making soft tissue products. While having long fiber length, the SSWK fibers have too wide a cell wall width and too narrow a lumen diameter and thus create stiffer, harsher feeling products than NSWK.

The tissue maker who is able to identify fibers having a desirable combination of fiber length and coarseness from fiber blends generally regarded as inferior with respect to average fiber properties may reap significant cost savings and/or product improvements. For example, the tissue maker may wish to make a tissue paper of superior strength without incurring the usual degradation in softness which accompanies higher strength. Alternatively, the papermaker may wish a higher degree of paper surface bonding to reduce the release of free fibers without suffering the usual decrease in softness which accompanies greater bonding of surface fibers. As such, a need currently exists for a tissue product formed from a fiber that will improve durability without negatively affecting other important product properties, such as softness.

SUMMARY OF THE DISCLOSURE

It has now been surprisingly discovered that the long, low-coarseness cellulosic fiber fraction of the tissue making furnish may be substituted with a blend of long, high-coarseness fiber and synthetic fibers without negatively affecting important tissue properties such as strength and stiffness. In some instances tissue product properties may actually be improved by substituting the long, low-coarseness cellulosic fiber fraction of the tissue furnish with a blend of long, high-coarseness fiber and synthetic fibers. For example, the present invention provides a soft and strong tissue comprising less than about percent, by weight of the product, long, low-coarseness cellulosic fibers, the product having a TS7 value of about 11.0 or less and a geometric mean tensile (GMT) from about 500 to about 1,200 g/3".

In other embodiments the present invention provides tissue products comprising high-coarseness cellulosic fibers and synthetic fibers, the product having a TS7 value of 11.0 or less and a GMT from about 500 to about 1,200 g/3". In a particularly preferred embodiment the tissue products of the present invention comprise less than about 10 percent, by weight of the product, long, low-coarseness cellulosic fibers, such as from about 0 to about 10 percent and more preferably from about 0 to about 5 percent. Compared to similarly manufactured tissue products consisting essentially of short cellulosic fibers and long, high-coarseness cellulosic fibers the inventive tissue products have improved strength with equal or improved softness.

In still other embodiments the present disclosure provides a tissue product comprising at least one tissue web, the tissue web comprising high-coarseness cellulosic fibers and synthetic fibers, the synthetic fibers having an average fiber length less than 6.0 mm and at least one cross-section dimension less than about 20 microns, such as from about 10 to about 20 microns, the tissue product having a GMT greater than about 500 g/3", a sheet bulk greater than about 10.0 cc/g, a TS7 value of 11.0 or less and a geometric mean tear (GM Tear) strength greater than about 10.0 N. Thus, the inventive tissue products have sufficient durability and strength to withstand use and are also soft and substantive in hand.

In yet other embodiments the present invention provides a tissue product comprising at least one through-air dried tissue web, the tissue web comprising high-coarseness cellulosic fibers and synthetic fibers, the synthetic fibers having an average fiber length less than 6.0 mm and at least one cross-section dimension less than about 20 microns, the product having a GMT from about 500 to about 1,200 g/3", a geometric mean slope (GM Slope) less than about 7.0 kg and a TS7 value of 11.0 or less.

In other embodiments the present invention provides a tissue product comprising a through-air dried tissue web comprising a fiber furnish consisting essentially of high-coarseness cellulosic fibers, short cellulosic fibers and synthetic fibers, the product having a GMT from about 500 to about 1,000 g/3", a geometric mean tensile energy absorption (GM TEA) greater than about 7.0 gm*cm/cm$^2$ and a TS7 value of 11.0 or less.

In still other embodiments the present disclosure provides an uncreped through-air dried tissue product comprising a fiber furnish consisting essentially of high-coarseness cellulosic fibers, short cellulosic fibers and synthetic fibers, the product having a GMT from about 500 to about 1,000 g/3", a geometric mean tensile energy absorption (GM TEA) greater than about 7.0 gm*cm/cm$^2$ and a TS7 value of 11.0 or less.

DESCRIPTIONS OF THE DRAWINGS

Figure 2:
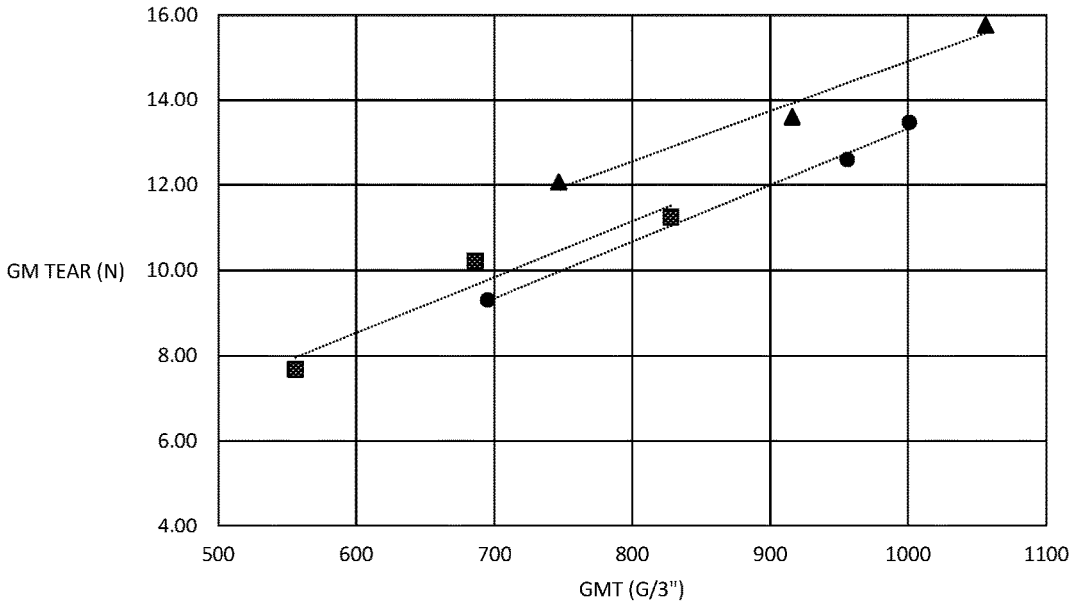
Figure 3:
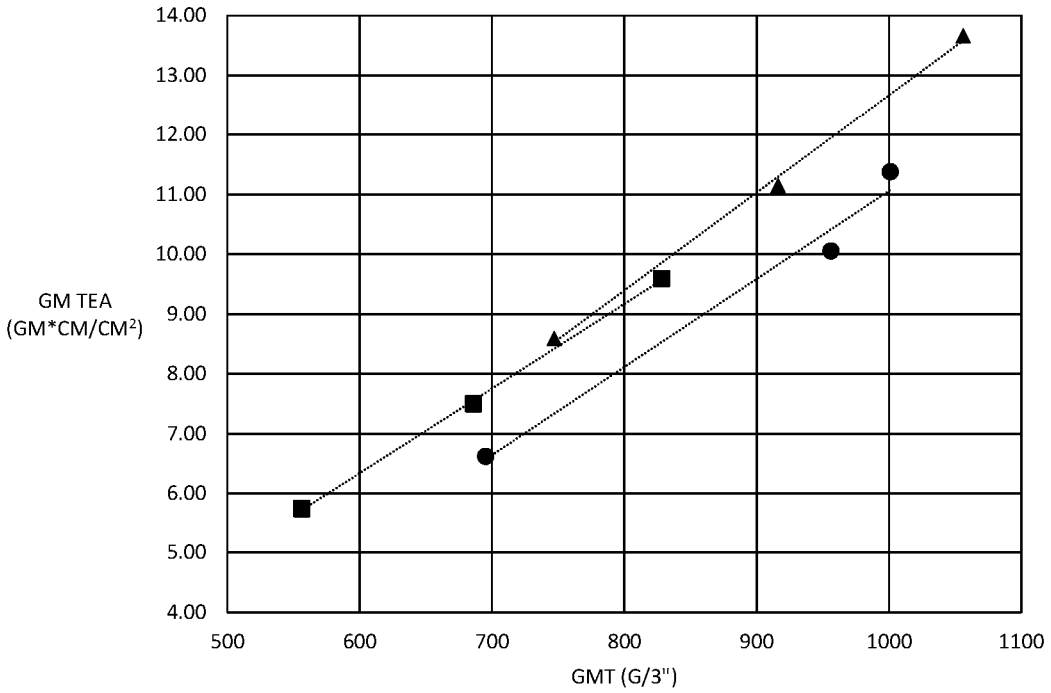

FIG. 1 is a graph of TS7 (y-axis) versus geometric mean tensile (GMT, x-axis) for three different tissue products manufactured at three different geometric mean tensile strengths, -●- are tissue products having three layers and comprising 40% NSWK and 60% EHWK, -■- are tissue products having three layers and comprising 40% SSWK and 60% EHWK; and -▲- are tissue products having three layers and comprising 37% SSWK, 3% synthetic fiber and 60% EHWK, a linear fitted curve through the data points has the equation TS7=0.0042*GMT+6.6367 and an $R^2$ value of 0.997;

FIG. 2 is a graph of geometric mean tear (y-axis) versus geometric mean tensile (GMT, x-axis) for three different tissue products manufactured at three different geometric mean tensile strengths, -●- are tissue products having three layers and comprising 40% NSWK and 60% EHWK, -■- are tissue products having three layers and comprising 40% SSWK and 60% EHWK; and -▲- are tissue products having three layers and comprising 37% SSWK, 3% synthetic fiber and 60% EHWK; and FIG. 3 is a graph of geometric mean tensile energy absorption (y-axis) versus geometric mean tensile (GMT, x-axis) for three different tissue products manufactured at three different geometric mean tensile strengths, -●- are tissue products having three layers and comprising 40% NSWK and 60% EHWK, -■- are tissue products having three layers and comprising 40% SSWK and 60% EHWK; and -▲- are tissue products having three layers and comprising 37% SSWK, 3% synthetic fiber and 60% EHWK.

DEFINITIONS

As used herein, the term "Average Fiber Length" means the length weighted average fiber length (LWAFL) of fibers determined utilizing OpTest Fiber Quality Analyzer, model FQA-360 (OpTest Equipment, Inc., Hawkesbury, ON). According to the test procedure, a pulp sample is treated with a macerating liquid to ensure that no fiber bundles or shives are present. Each pulp sample is disintegrated into hot water and diluted to an approximately 0.001 percent solution. Individual test samples are drawn in approximately 50 to 100 ml portions from the dilute solution when tested using the standard Kajaani fiber analysis test procedure. The weighted average fiber length may be expressed by the following equation:

$$\sum_{x_i=0}^{k}(x_i \times n_i)/n$$

where k=maximum fiber length
$x_i$=fiber length
$n_i$=number of fibers having length $x_i$
n=total number of fibers measured.

As used herein, the term "Coarseness" means the fiber mass per unit of unweighted fiber length reported in units of milligrams per one hundred meters of unweighted fiber length (mg/100 m) as measured using a suitable fiber coarseness measuring device such as the above OpTest Fiber Quality Analyzer. The coarseness of the pulp is an average of three coarseness measurements of three fiber specimens taken from the pulp. The operation of the analyzer for measuring coarseness is similar to the operation for measuring fiber length described above.

As used herein the term "Fiber" means an elongate particulate having an apparent length greatly exceeding its apparent width. More specifically, and as used herein, fiber means such fibers suitable for a papermaking process and more particularly the tissue paper making process.

As used herein the term "Cellulosic Fiber" means a fiber composed of or derived from cellulose.

As used herein, the term "Long Cellulosic Fibers" means a cellulosic fiber having an average fiber length greater than 1.2 mm and more preferably greater than about 1.5 mm and still more preferably greater than about 2.0 mm.

As used herein the term "Short Cellulosic Fibers" means a cellulosic fiber having an average length less than about 1.2 mm, such as from about 0.4 to about 1.2 mm, such as from about 0.5 to about 0.75 mm, and more preferably from about 0.6 to about 0.7 mm. One example of short cellulosic fibers are hardwood pulp fibers, which may be derived from hardwoods selected from the group consisting of Acacia, *Eucalyptus*, Maple, Oak, Aspen, Birch, Cottonwood, Alder, Ash, Cherry, Elm, Hickory, Poplar, Gum, Walnut, Locust, Sycamore and Beech. In other embodiments short cellulosic fibers may be derived tom non-wood plants such as Bagasse, Flax, Hemp, and Kenaf.

As used herein, the term "High-Coarseness Cellulosic Fiber" means a cellulosic fiber having a coarseness greater than 17 mg/100 m and more preferably greater than about 19 mg/100 m, such as from about 17 to about 23 mg/100 m. High coarseness fibers may be softwood pulp fibers derived from a pine in the *Pinus* subgenus including, for example, *P. taeda, P. elliotti, P. palustris, P. pungens, P. rigida, P. seroina, P. muricata* and *P. radiate.*

As used herein, the term "Low-Coarseness Cellulosic Fiber" means a cellulosic fiber having a coarseness less than 17 mg/100 m and more preferably less than about 16 mg/100 m. Low coarseness fibers may be softwood pulp fibers derived from conifers in the genus *Pseudotsuga, Tsuga, Picea* or *Thuja.*

As used herein the term "Synthetic Fiber" means a non-cellulosic, thermoplastic fiber.

As used herein the term "Thermoplastic" means a plastic which becomes pliable or moldable above a specific temperature and returns to a solid state upon cooling. Exemplary thermoplastic fibers suitable for the present embodiments include polyesters (e.g., polyalkylene terephthalates such as polyethylene terephthalate (PET), polybutylene terephthalate (PBT) and the like), polyalkylenes (e.g., polyethylenes, polypropylenes and the like), poyacrylonitriles (PAN), and polyamides (nylons, for example, nylon-6, nylon 6,6, nylon-6,12, and the like). Preferred are PET fibers.

As used herein, the term "Tissue Product" means products made from tissue webs and includes, bath tissues, facial tissues, paper towels, industrial wipers, foodservice wipers, napkins, medical pads, and other similar products.

As used herein, the terms "Tissue Web" means a fibrous sheet material suitable for use as a tissue product.

As used herein, the term "Ply" means a discrete product element. Individual plies may be arranged in juxtaposition to each other. The term may refer to a plurality of web-like components such as in a multi-ply facial tissue, bath tissue, paper towel, wipe, or napkin.

As used herein, the term "Layer" means a plurality of strata of fibers, chemical treatments, or the like, within a ply.

As used herein, the terms "Layered," "Multi-Layered," and the like, refer to fibrous sheets prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

As used herein the term "Basis Weight" means the bone dry weight per unit area of a tissue and is generally expressed as grams per square meter (gsm). Basis weight is measured using TAPPI test method T-220. While basis weight may be varied, tissue products prepared according to the present invention and comprising one, two or three plies, generally have a basis weight greater than about gsm, such as from about 25 to about 60 gsm and more preferably from about 30 to about 45 gsm.

As used herein the term "Caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein the term "Sheet Bulk" refers to the quotient of the caliper (generally having units of μm) divided by the bone dry basis weight (generally having units of gsm). The resulting sheet bulk is expressed in cubic centimeters per gram (cc/g). Through-air dried tissue products prepared according to the present invention generally have a sheet bulk greater than about 8 cc/g, more preferably greater than about 10 cc/g and still more preferably greater than about 12 cc/g, such as from about 8 to about cc/g and more preferably from about 12 to about 18 cc/g. Creped wet pressed tissue products prepared according to the present invention generally have a sheet bulk greater than about 5 cc/g, more preferably greater than about 7 cc/g, such as from about 5 to about 12 cc/g.

As used herein, the term "Geometric Mean Tensile" (GMT) refers to the square root of the product of the machine direction tensile strength and the cross-machine direction tensile strength of the tissue product. While the GMT may vary, tissue products prepared according to the present invention generally have a GMT greater than about 500 g/3", more preferably greater than about 600 g/3" and still more preferably greater than about 800 g/3", such as from about 500 to about 1,200 g/3".

As used herein, the term "Slope" refers to the slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams (g) or kilograms (kg).

As used herein, the term "Geometric Mean Slope" (GM Slope) refers to the square root of the product of machine direction slope and cross-machine direction slope. GM Slope generally is expressed in units of kilograms (kg). While the GM Slope may vary, tissue products prepared according to the present invention generally have a GM Slope less than about 15.0 kg, more preferably less than about 10.0 kg and still more preferably less than about 8.0 kg.

As used herein, the term "Stiffness Index" refers to GM Slope (having units of kg), divided by GMT (having units of g/3") multiplied by 1,000. While the Stiffness Index may vary, tissue products prepared according to the present invention generally have a Stiffness Index less than about 10.0, more preferably less than about 8.0 and still more preferably less than about 6.0.

As used herein, the term "Geometric Mean Tensile Energy Absorption" (GM TEA) refers to the square root of the product MD TEA and CD TEA, which are measured in the course of determining tensile strength as described below. GM TEA has units of $gm*cm/cm^2$.

As used herein, the terms "TS7" and "TS7 value" refer to the output of the EMTEC Tissue Softness Analyzer (commercially available from Emtec Electronic GmbH, Leipzig, Germany) as described in the Test Methods section. TS7 has units of dB V2 rms, however, TS7 may be referred to herein without reference to units. In certain embodiments the invention provides through-air dried tissue products comprising synthetic fibers and high coarseness cellulosic fibers where the products have a TS7 less than about 11.0, and more preferably less than about 10.0, such as from about 8.0 to about 11.0. The foregoing TS7 values are generally achieved at geometric mean tensile strengths from about 500 to about 1,200 g/3".

As used herein the term "Substantially Free" when used in reference to a given layer of a multi-layered fibrous web means the given layer comprises less than about 0.25 percent of the subject fiber, by weight of the layer. The foregoing amounts of fiber are generally considered negligible and do not affect the physical properties of the layer. Moreover the presence of negligible amounts of subject fibers in a given layer generally arise from fibers disposed in an adjacent layer, and have not been purposefully disposed in a given layer. For example where a given layer of a multi-layered tissue web is said to be substantially free of wood pulp fibers, the given layer generally comprises less than about 0.25 percent wood pulp fiber, by weight of the layer.

DETAILED DESCRIPTION OF THE DISCLOSURE

The present invention provides tissue products and webs comprising high-coarseness cellulosic fibers and synthetic fibers. Surprisingly the high-coarseness cellulosic fibers and synthetic fiber may replace a substantial portion, or in some instances all, of the long, low-coarseness cellulosic fiber in the furnish without negatively affecting important tissue properties such as strength and softness. For example, in one embodiment, the present invention provides a method of manufacturing a tissue product comprising the steps of providing a short cellulosic fiber, a synthetic fiber and a high-coarseness fiber, dispersing the fibers in water to form a fiber slurry, depositing the fiber slurry on a forming fabric to form a wet tissue web, drying the tissue web and converting the dried tissue web into a tissue product, where the tissue product has a TS7 value less than about 11.0 and a geometric mean tensile (GMT) greater than about 500 g/3" and more preferably greater than about 700 g/3", such as from about 500 to about 1,200 g/3". In the foregoing method the furnish may comprise from about 0 to about 10 percent (based upon the dry weight of the furnish) long, low-coarseness cellulosic fiber, more preferably from about 0 to about 5 weight percent. In other embodiments the furnish used to form the inventive tissue webs and products may be substantially free from long, low-coarseness cellulosic fibers.

The ability to manufacture tissue webs and products having acceptable strength and softness using little or no long, low-coarseness cellulosic fiber is achieved in-part by using modest amounts of synthetic fiber, such as less than about 10 percent, by weight of the tissue web or product. As such the tissue webs and products of the present invention generally comprise at least about 1.0 percent, by weight of the tissue web or product, synthetic fibers and more preferably at least about 2.0 percent, such as from about 1.0 to about 10 percent and more preferably from about 1.5 to about 8.0 percent and still more preferably from about 2.0 to about 5.0 percent. In particularly preferred embodiments the inventive tissue products comprise from about 2.0 to about 5.0 percent, by weight of the tissue product, synthetic fibers, but are substantially free from long, low-coarseness cellulosic fibers.

Suitable synthetic fibers for use in the present invention include polyesters (e.g., polyalkylene terephthalates such as polyethylene terephthalate (PET), polybutylene terephthalate (PBT) and the like), polyalkylenes (e.g., polyethylenes, polypropylenes and the like), poyacrylonitriles (PAN), and polyamides (nylons, for example, nylon-6, nylon 6,6, nylon-6,12, and the like). Preferably the synthetic fiber is non-fibrillated and more preferably the synthetic fiber is a non-fibrillated PET fiber.

In particularly preferred embodiments synthetic fibers useful in the present invention may have at least one cross-section dimension less than about 20 microns, more preferably less than about 10 microns and still more preferably less than about 15.0 microns, such as from about 1.0 to about 20 microns, and more preferably from about 5.0 to about 15.0 microns. In other embodiments the synthetic fibers may have an average fiber length less than 10.0 mm, and more preferably less than about 8.0 mm and still more preferably less than about 6.0 mm, such as from about 1.0 to about 10.0 mm and more preferably from about 4.0 to about 6.0 mm.

While synthetic fibers useful in the present invention may have at least one cross-section dimension less than about 20 microns, they may have any number of different cross-sectional shapes including, round, flat and wedge. In one particularly preferred embodiment the tissue webs and products of the present invention comprise synthetic fibers having a substantially round cross section and a diameter from about 1.0 to about 5.0 microns and more preferably from about 2.0 to about 5.0 microns. Exemplary synthetic fibers having a substantially round cross section include those commercially available under the tradename CYPHREX™ 10001 and 10002 (Eastman Chemical Co., Kingsport, Tenn.). In other embodiments the synthetic fiber may have a flat cross section where at least one of the fiber dimensions is less than about 10 microns, and more preferably less than about 5.0 microns, such as from about 1.0 to about 5.0 microns. Exemplary synthetic fibers having a flat cross section include those commercially available under the tradename CYPHREX™ 10101 (Eastman Chemical Co., Kingsport, Tenn.).

Tissue webs and products made in accordance with the present disclosure can be made with a homogeneous fiber furnish or can be formed from a stratified fiber furnish producing layers within the web or product. Stratified base webs can be formed using equipment known in the art, such as a multi-layered headbox. For example, in certain embodiments, the tissue products may be prepared from multi-layered webs having a first outer layer, a middle layer and a second outer layer. In one embodiment the first and second outer layers may primarily contain short cellulosic fiber, such as hardwood pulp fibers. The short cellulosic fibers can be mixed, if desired, with paper broke in an amount up to about 10 percent by weight and/or long cellulosic fiber in an amount up to about 10 percent by weight. The middle layer, which is generally positioned in between the first outer layer and the second outer layer may contain a mixture of high coarseness fibers and synthetic fibers, and more preferably a mixture of long, high coarseness wood pulp fibers, such as Southern softwood kraft pulp fibers (SSWK) and synthetic fibers, such as a synthetic fiber having at least one cross-section dimension less than about 20 microns and an average fiber length less than about 10.0 mm. In a particularly preferred embodiment the middle layer is substantially free from long, low coarseness cellulosic fibers.

In other embodiments the invention provides multi-layered webs having a first outer layer, a middle layer and a second outer layer where synthetic fiber is disposed in one or more of the outer layers and optionally in the middle layer. For example, a multi-layered tissue web may have a first layer comprising a furnish consisting essentially of short cellulosic fiber and synthetic fiber, wherein the synthetic fiber comprises less than about 5.0 percent, by weight of the layer, and more preferably less than about 3.0 percent, a middle layer comprising a furnish consisting essentially of high coarseness fibers and synthetic fibers and a second outer layer comprising furnish consisting essentially of short cellulosic fiber.

While in certain embodiments it is preferred that the tissue web comprise multiple layers, it should be understood that tissue products made from the foregoing multi-layered web can include any number of plies and the plies may be made from various combinations of single- and multi-layered tissue webs. Further, tissue webs prepared according to the present invention may be incorporated into tissue products that may be either single- or multi-ply, where one or more of the plies may be formed by a multi-layered tissue web having high coarseness cellulosic fibers and synthetic fibers selectively incorporated in one of its layers.

Surprisingly, in certain embodiments, long, high coarseness cellulosic fibers and synthetic fiber may replace all of the long, low-coarseness cellulosic fiber fraction of the tissue making furnish and still produce a tissue product having satisfactory properties. For example, the tissue product may comprise from about 10 to about 50 percent, by weight of the tissue product, high coarseness cellulosic fibers and from about 1.0 to about 5.0 percent synthetic fibers and be substantially free of long, low-coarseness cellulosic fiber. Despite comprising high coarseness cellulosic fiber and being substantially free of long, low-coarseness cellulosic fiber the product may have a TS7 value less than about 11.0 and a geometric mean tensile (GMT) greater than about 500 g/3" and more preferably greater than about 700 g/3", such as from about 500 to about 1,200 g/3".

In other embodiments the TS7 value of tissue products prepared according to the present example may be expressed as a function of GMT according to the formula:

$$TS7 \leq 3\ 0.0042 * GMT + 6.6367$$

where GMT has units of grams per three inches. Accordingly, in one preferred embodiment the present invention provides a tissue product formed from a fiber furnish comprising at least about 20 percent high coarseness fibers and from about 1.0 to about 5.0 percent synthetic fibers and less than about 10 percent long, low-coarseness cellulosic fibers, such as from about 0 to about 10 percent, the product having a TS7 value less than or equal to 0.0042 multiplied by the geometric mean tensile (having units of g/3") plus 6.6367 and a geometric mean tensile from about 700 to about 1,100 g/3".

In other embodiments the use of high coarseness cellulosic fibers and synthetic fibers result in tissue products having surprisingly good softness at a given tensile strength and good durability. For example, the present invention provides a tissue product formed from a fiber furnish comprising at least about 20 percent high coarseness fibers and from about 1.0 to about 5.0 percent synthetic fibers and less than about 10 percent long, low-coarseness cellulosic fibers, such as from about 0 to about 10 percent, the product having a TS7 value less than about 11.0 and a geometric mean tensile from about 500 to about 1,200 g/3" and a GM TEA greater than about 7.0 g*cm/cm$^2$, such as from about 7.0 to about 18 g*cm/cm$^2$.

Not only does the combination of long, high-coarseness fibers and synthetic fibers provide softness, strength and durability, they may also be incorporated into a product to provide good flexibility.

For example, in one embodiment the present invention provides a tissue product formed from a fiber furnish comprising at least about 20 percent high coarseness fibers and from about 1.0 to about 5.0 percent synthetic fibers and less than about 10 percent long, low-coarseness cellulosic fibers, such as from about 0 to about 10 percent, the product having a TS7 value less than about 11.0 and a GM Slope less than about 10.0 kg, such as from about 4.0 to about 10.0 kg and more preferably from about 4.0 to about 7.0 kg. The foregoing GM Slopes are generally achieved at geometric mean tensile strengths from about 500 to about 1,200 g/3", and more preferably from about 700 to about 1,000 g/3". At the foregoing GM Slopes and GMTs, the tissue products may have a Stiffness Index less than about 8.0, such as from about 4.0 to about 8.0 and more preferably from about 4.0 to about 6.0.

The tissue products of the present disclosure can generally be formed by any of a variety of papermaking processes known in the art. Preferably the tissue web is formed by either conventional wet pressing or by through-air drying and be either creped or uncreped. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554, all of which are incorporated herein in a manner consistent with the present disclosure. When forming multi-ply tissue products, the separate plies can be made from the same process or from different processes as desired.

In a particularly preferred embodiment at least one web of the tissue product is formed by an uncreped through-air drying process, such as the process described, for example, in U.S. Pat. Nos. 5,656,132 and 6,017,417, both of which are hereby incorporated by reference herein in a manner consistent with the present disclosure.

In one embodiment the web is formed using a twin wire former having a papermaking headbox that injects or deposits a furnish of an aqueous suspension of papermaking fibers onto a plurality of forming fabrics, such as the outer forming fabric and the inner forming fabric, thereby forming a wet tissue web. The forming process of the present disclosure may be any conventional forming process known in the papermaking industry. Such formation processes include, but are not limited to, Fourdriniers, roof formers such as suction breast roll formers, and gap formers such as twin wire formers and crescent formers.

The wet tissue web forms on the inner forming fabric as the inner forming fabric revolves about a forming roll. The inner forming fabric serves to support and carry the newly-formed wet tissue web downstream in the process as the wet tissue web is partially dewatered to a consistency of about 10 percent based on the dry weight of the fibers. Additional dewatering of the wet tissue web may be carried out by known paper making techniques, such as vacuum suction boxes, while the inner forming fabric supports the wet tissue web. The wet tissue web may be additionally dewatered to a consistency of greater than 20 percent, more specifically between about 20 to about 40 percent, and even more specifically between about 20 to about 30 percent.

The forming fabric can generally be made from any suitable porous material, such as metal wires or polymeric filaments. For instance, some suitable fabrics can include, but are not limited to, Albany 84M and 94M available from Albany International (Albany, N.Y.); Asten 856, 866, 867, 892, 934, 939, 959, or 937; Asten Synweve Design 274, all of which are available from Asten Forming Fabrics, Inc. (Appleton, Wis.); and Voith 2164 available from Voith Fabrics (Appleton, Wis.).

The wet web is then transferred from the forming fabric to a transfer fabric while at a solids consistency of between about 10 to about 35 percent, and particularly, between about 20 to about 30 percent. As used herein, a "transfer fabric" is a fabric that is positioned between the forming section and the drying section of the web manufacturing process.

Transfer to the transfer fabric may be carried out with the assistance of positive and/or negative pressure. For example, in one embodiment, a vacuum shoe can apply negative pressure such that the forming fabric and the transfer fabric simultaneously converge and diverge at the leading edge of the vacuum slot. Typically, the vacuum shoe supplies pressure at levels between about 10 to about 25 inches of mercury. As stated above, the vacuum transfer shoe (negative pressure) can be supplemented or replaced by the use of positive pressure from the opposite side of the web to blow the web onto the next fabric. In some embodiments, other vacuum shoes can also be used to assist in drawing the fibrous web onto the surface of the transfer fabric.

Typically, the transfer fabric travels at a slower speed than the forming fabric to enhance the MD and CD stretch of the web, which generally refers to the stretch of a web in its cross (CD) or machine direction (MD) (expressed as percent elongation at sample failure). For example, the relative speed difference between the two fabrics can be from about 30 to about 70 percent and more preferably from about 40 to about 60 percent. This is commonly referred to as "rush transfer". During rush transfer many of the bonds of the web are believed to be broken, thereby forcing the sheet to bend and fold into the depressions on the surface of the transfer fabric. Such molding to the contours of the surface of the transfer fabric may increase the MD and CD stretch of the web. Rush transfer from one fabric to another can follow the principles taught in any one of the following patents, U.S. Pat. Nos. 5,667,636, 5,830,321, 4,440,597, 4,551,199, 4,849,054, all of which are hereby incorporated by reference herein in a manner consistent with the present disclosure.

The wet tissue web is then transferred from the transfer fabric to a through-air drying fabric. Typically, the transfer fabric travels at approximately the same speed as the through-air drying fabric. However, a second rush transfer may be performed as the web is transferred from the transfer fabric to the through-air drying fabric. This rush transfer is referred to as occurring at the second position and is achieved by operating the through-air drying fabric at a slower speed than the transfer fabric.

In addition to rush transferring the wet tissue web from the transfer fabric to the through-air drying fabric, the wet tissue web may be macroscopically rearranged to conform to the surface of the through-air drying fabric with the aid of a vacuum transfer roll or a vacuum transfer shoe. If desired, the through-air drying fabric can be run at a speed slower than the speed of the transfer fabric to further enhance MD stretch of the resulting absorbent tissue product. The transfer may be carried out with vacuum assistance to ensure conformation of the wet tissue web to the topography of the through-air drying fabric.

While supported by a through-air drying fabric, the wet tissue web is dried to a final consistency of about 94 percent or greater by a through-air dryer. The web then passes through the winding nip between the reel drum and the reel and is wound into a roll of tissue for subsequent converting. Converting may include, for example, printing, embossing, calendering, slitting, folding, winding, combining with other tissue webs, and the like. Converting of the web generally results in a tissue product that is intended for use by a consumer.

TEST METHODS

Tissue Softness

Tissue softness was measured using an EMTEC Tissue Softness Analyzer ("TSA") (Emtec Electronic GmbH, Leipzig, Germany). The TSA comprises a rotor with vertical blades which rotate on the test piece applying a defined contact pressure. Contact between the vertical blades and the test piece creates vibrations, which are sensed by a vibration sensor. The sensor then transmits a signal to a PC for processing and display. The signal is displayed as a frequency spectrum. For measurement of TS7 values the blades are pressed against the sample with a load of 100 mN and the rotational speed of the blades is 2 revolutions per second.

The frequency analysis in the range of approximately 200 to 1000 Hz represents the surface smoothness or texture of the test piece. A high amplitude peak correlates to a rougher surface. A further peak in the frequency range between 6 and 7 kHz represents the softness of the test piece. The peak in the frequency range between 6 and 7 kHz is herein referred to as the TS7 Softness Value and is expressed as dB V2 rms. The lower the amplitude of the peak occurring between 6 and 7 kHz, the softer the test piece.

Test samples were prepared by cutting a circular sample having a diameter of 112.8 mm. All samples were allowed to equilibrate at TAPPI standard temperature and humidity conditions for at least 24 hours prior to completing the TSA testing. Only one ply of tissue is tested. Multi-ply samples are separated into individual plies for testing. The sample is placed in the TSA with the softer (dryer or Yankee) side of the sample facing upward. The sample is secured and the measurements are started via the PC. The PC records, processes and stores all of the data according to standard TSA protocol. The reported values are the average of five replicates, each one with a new sample.

Tear

Tear testing was carried out in accordance with TAPPI test method T-414 "Internal Tearing Resistance of Paper (Elmendorf-type method)" using a falling pendulum instrument such as Lorentzen & Wettre Model SE 009. Tear strength is directional and MD and CD tear are measured independently.

More particularly, a rectangular test specimen of the sample to be tested is cut out of the tissue product or tissue basesheet such that the test specimen measures 63±0.15 mm (2.5±0.006 inches) in the direction to be tested (such as the MD or CD direction) and between 73 and 114 millimeters (2.9 and 4.6 inches) in the other direction. The specimen edges must be cut parallel and perpendicular to the testing direction (not skewed). Any suitable cutting device, capable of the prescribed precision and accuracy, can be used. The test specimen should be taken from areas of the sample that are free of folds, wrinkles, crimp lines, perforations or any other distortions that would make the test specimen abnormal from the rest of the material.

The number of plies or sheets to test is determined based on the number of plies or sheets required for the test results to fall between 20 to 80 percent on the linear range scale of the tear tester and more preferably between 20 to 60 percent of the linear range scale of the tear tester. The sample preferably should be cut no closer than 6 mm (0.25 inch) from the edge of the material from which the specimens will be cut. When testing requires more than one sheet or ply the sheets are placed facing in the same direction.

The test specimen is then placed between the clamps of the falling pendulum apparatus with the edge of the specimen aligned with the front edge of the clamp. The clamps are closed and a 20-millimeter slit is cut into the leading edge of the specimen usually by a cutting knife attached to the instrument. For example, on the Lorentzen & Wettre Model SE 009 the slit is created by pushing down on the cutting knife lever until it reaches its stop. The slit should be clean with no tears or nicks as this slit will serve to start the tear during the subsequent test.

The pendulum is released and the tear value, which is the force required to completely tear the test specimen, is recorded. The test is repeated a total of ten times for each sample and the average of the ten readings reported as the tear strength. Tear strength is reported in units of grams of force (gf). The average tear value is the tear strength for the direction (MD or CD) tested. The "geometric mean tear strength" is the square root of the product of the average MD tear strength and the average CD tear strength. The Lorentzen & Wettre Model SE 009 has a setting for the number of plies tested. Some testers may need to have the reported tear strength multiplied by a factor to give a per ply tear strength. For basesheets intended to be multiple ply products, the tear results are reported as the tear of the multiple ply product and not the single ply basesheet. This is done by multiplying the single ply basesheet tear value by the number of plies in the finished product. Similarly, multiple ply finished product data for tear is presented as the tear strength for the finished product sheet and not the individual plies. A variety of means can be used to calculate but in general will be done by inputting the number of sheets to be tested rather than number of plies to be tested into the measuring device. For example, two sheets would be two 1-ply sheets for 1-ply product and two 2-ply sheets (4-plies) for 2-ply products.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3±0.05 inches (76.2±1.3 mm) wide strip in either the machine direction (MD) or cross-machine direction (CD) orientation using a JDC Precsion Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4 0.04 inches (101.6±1 mm) for facial tissue and towels and 2±0.02 inches (50.8±0.5 mm) for bath tissue. The crosshead speed was 10*0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm*cm/cm$^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

Multi-ply products were tested as multi-ply products and results represent the tensile strength of the total product. For example, a 2-ply product was tested as a 2-ply product and recorded as such. A basesheet intended to be used for a 2-ply product was tested as two plies and the tensile recorded as such. Alternatively, a single ply may be tested and the result multiplied by the number of plies in the final product to get the tensile strength.

EXAMPLES

Base sheets were made using a through-air dried papermaking process commonly referred to as "uncreped through-air dried" ("UCTAD") and generally described in U.S. Pat. No. 5,607,551, the contents of which are incorporated herein in a manner consistent with the present invention. Inventive base sheets were produced from a furnish comprising northern softwood kraft (NSWK), *eucalyptus* hardwood kraft (EHWK), Southern softwood kraft (SSWK), and/or synthetic fibers using a layered headbox fed by three stock chests such that the webs having three layers (two outer layers and a middle layer) were formed. The synthetic fibers were CYPHREX™ 10001 (Eastman Chemical Co., Kingsport, Tenn.) and had the following properties:

TABLE 1

| Synthetic Fiber Type | Polymer Type | Cross-section Shape | Tradename | Minimum Fiber Dimension (μm) | Fiber Length (mm) |
|---|---|---|---|---|---|
| 2.5/R | PET | Round | CYPHREX ™ 10001 | 2.5 | 1.5 |

Rolled bath tissue products were formed from a three layer web having a target basis weight of about gsm. The layer splits, by weight of the web, are detailed in Table 2, below.

TABLE 2

| | Middle Layer (wt %) | | Outer Layers (wt %) | | Redibond 2038A |
|---|---|---|---|---|---|
| Code | NSWK (wt %) | SSWK (wt %) | Synthetic (wt %) | EHWK (wt %) | Starch (kg/MT) |
| Control 1 | 40 | — | — | 60 | 0 |
| Control 2 | 40 | 0 | 0 | 60 | 3 |
| Control 3 | 40 | 0 | 0 | 60 | 6 |
| Control 4 | 0 | 40 | 0 | 60 | 0 |
| Control 5 | 0 | 40 | 0 | 60 | 3 |
| Control 6 | 0 | 40 | 0 | 60 | 6 |
| Inventive 1 | 0 | 37 | 3 | 60 | 0 |
| Inventive 2 | 0 | 37 | 3 | 60 | 3 |
| Inventive 3 | 0 | 37 | 3 | 60 | 6 |
| Inventive 4 | 0 | 34 | 6 | 60 | 0 |
| Inventive 5 | 0 | 34 | 6 | 60 | 3 |
| Inventive 6 | 0 | 34 | 6 | 60 | 6 |
| Inventive 7 | 0 | 37 | 6 | 57 | 0 |
| Inventive 8 | 0 | 37 | 6 | 57 | 3 |
| Inventive 9 | 0 | 37 | 6 | 57 | 6 |
| Inventive 10 | 0 | 35 | 10 | 55 | 0 |
| Inventive 11 | 0 | 35 | 10 | 55 | 2.5 |
| Inventive 12 | 0 | 35 | 10 | 55 | 6 |

The tissue web was formed on a Voith Fabrics TissueForm V forming fabric, vacuum dewatered to approximately 25 percent consistency and then subjected to rush transfer when transferred to the transfer fabric. The layer splits, by weight of the web, are detailed in Table 2, above. The transfer fabric was the fabric described as t1207-11 (commercially available from Voith Fabrics, Appleton, Wis.). The web was then transferred to a through-air drying fabric. Transfer to the through-air drying fabric was done using vacuum levels of greater than 10 inches of mercury at the transfer. The web was then dried to approximately 98 percent solids before winding.

The base sheet webs were converted into rolled bath products by calendering using a conventional polyurethane/steel calender comprising a 4 P&J polyurethane roll on the air side of the sheet and a standard steel roll on the fabric side. The finished product comprised a single ply of base sheet. The finished products were subjected to physical testing, the results of which are summarized in Table 3 and Table 4, below.

TABLE 3

| Code | Basis Weight (gsm) | Caliper (microns) | Sheet Bulk (cc/g) | GMT | GM Slope | Stiff-ness Index | TS7 |
|---|---|---|---|---|---|---|---|
| Control 1 | 35.3 | 421 | 11.9 | 695 | 5.83 | 8.39 | 9.98 |
| Control 2 | 35.4 | 467 | 13.2 | 956 | 6.66 | 6.97 | 10.79 |
| Control 3 | 34.8 | 441 | 12.7 | 1001 | 6.27 | 6.26 | 11.28 |
| Control 4 | 35.1 | 456 | 13.0 | 556 | 5.23 | 9.41 | 10.11 |
| Control 5 | 35.2 | 449 | 12.8 | 686 | 5.54 | 8.08 | 10.59 |
| Control 6 | 35.7 | 471 | 13.2 | 828 | 6.33 | 7.64 | 11.42 |

TABLE 3-continued

| Code | Basis Weight (gsm) | Caliper (microns) | Sheet Bulk (cc/g) | GMT | GM Slope | Stiff-ness Index | TS7 |
|---|---|---|---|---|---|---|---|
| Inventive 1 | 34.8 | 440 | 12.6 | 747 | 5.73 | 7.67 | 9.76 |
| Inventive 2 | 36.2 | 456 | 12.6 | 916 | 6.35 | 6.93 | 10.40 |
| Inventive 3 | 36.2 | 453 | 12.5 | 1056 | 6.57 | 6.22 | 11.04 |
| Inventive 4 | 36.1 | 435 | 12.1 | 869 | 5.66 | 6.51 | 9.58 |
| Inventive 5 | 37.2 | 459 | 12.4 | 1038 | 5.59 | 5.39 | 10.67 |
| Inventive 6 | 36.5 | 457 | 12.5 | 1152 | 6.68 | 5.80 | 11.72 |
| Inventive 7 | 35.4 | 426 | 12.0 | 774 | 5.12 | 6.61 | 9.22 |
| Inventive 8 | 36.1 | 429 | 11.9 | 970 | 5.66 | 5.84 | 9.80 |
| Inventive 9 | 36.5 | 451 | 12.4 | 1085 | 6.19 | 5.71 | 10.60 |
| Inventive 10 | 36.2 | 431 | 11.9 | 866 | 4.68 | 5.40 | 8.47 |
| Inventive 11 | 35.8 | 445 | 12.4 | 974 | 5.32 | 5.46 | 9.55 |
| Inventive 12 | 36.0 | 462 | 12.8 | 1137 | 6.01 | 5.29 | 10.35 |

TABLE 4

| Code | CD TEA (g*cm/cm$^2$) | CD Slope (kg) | MD Stretch (%) | CD Tear (N) | GM Stretch (%) | GM TEA (g*cm/cm$^2$) | GM Tear (N) |
|---|---|---|---|---|---|---|---|
| Control 1 | 3.86 | 5.02 | 14.5 | 14.5 | 11.1 | 6.6 | 9.3 |
| Control 2 | 6.10 | 5.40 | 17.0 | 17.0 | 13.1 | 10.1 | 12.6 |
| Control 3 | 6.89 | 4.36 | 16.4 | 16.4 | 14.1 | 11.4 | 13.5 |
| Control 4 | 3.65 | 3.50 | 12.9 | 12.9 | 11.6 | 5.8 | 7.7 |
| Control 5 | 4.48 | 3.33 | 13.7 | 13.7 | 12.5 | 7.5 | 10.2 |
| Control 6 | 6.25 | 3.94 | 14.3 | 14.3 | 13.2 | 9.6 | 11.3 |
| Inventive 1 | 5.34 | 4.19 | 14.9 | 14.9 | 12.8 | 8.6 | 12.1 |
| Inventive 2 | 7.15 | 4.30 | 16.0 | 16.0 | 14.0 | 11.2 | 13.6 |
| Inventive 3 | 9.09 | 3.96 | 16.4 | 16.4 | 15.2 | 13.7 | 15.8 |
| Inventive 4 | 6.64 | 4.38 | 16.4 | 16.4 | 14.1 | 10.5 | 13.5 |
| Inventive 5 | 8.23 | 3.91 | 17.0 | 17.0 | 15.4 | 13.2 | 16.5 |
| Inventive 6 | 9.94 | 4.55 | 17.4 | 17.4 | 15.8 | 15.1 | 15.8 |
| Inventive 7 | 6.30 | 3.58 | 16.2 | 16.2 | 14.6 | 9.8 | 15.3 |
| Inventive 8 | 8.36 | 4.16 | 17.8 | 17.8 | 15.9 | 12.9 | 16.9 |
| Inventive 9 | 9.97 | 3.85 | 17.5 | 17.5 | 16.3 | 15.2 | 19.6 |
| Inventive 10 | 8.05 | 3.62 | 17.5 | 17.5 | 16.0 | 11.7 | 15.9 |
| Inventive 11 | 8.44 | 3.80 | 17.9 | 17.9 | 16.1 | 13.1 | 17.3 |
| Inventive 12 | 10.94 | 4.31 | 18.2 | 18.2 | 16.7 | 16.1 | 21.4 |

The foregoing represents several examples of inventive tissue products prepared according to the present disclosure. In other embodiments, such as a first embodiment, the present invention provides a tissue product comprising at least about 10 weight percent high coarseness fibers, from about 1.0 to about 10.0 weight percent synthetic fibers and less than about 10 weight percent long, low-coarseness cellulosic fibers, the product having a TS7 value less than about 11.0 and a geometric mean tensile from about 500 to about 1,200 g/3". Preferably the tissue product comprises at least one wet-laid tissue web.

In a second embodiment the present invention provides the tissue product of the first embodiment wherein the tissue product is substantially free from long, low-coarseness cellulosic fibers.

In a third embodiment the present invention provides the tissue product of the first or second embodiments wherein the tissue web comprises from about 1.0 to about 5.0 percent synthetic fiber, by weight of the tissue product.

In a fourth embodiment the present invention provides the tissue product of any one of the first through third embodiments wherein the synthetic fiber is a non-fibrillated polyethylene terephthalate (PET) fiber.

In a fifth embodiment the present invention provides the tissue product of any one of the first through fourth embodiments wherein the synthetic fiber has a substantially circular cross section and a diameter from about 0.5 to about 10 microns.

In a sixth embodiment the present invention provides the tissue product of any one of the first through fifth embodiments having a GMT from about 800 to about 1,200 g/3" and a GM Slope from about 5.0 to about 8.0 kg.

In a seventh embodiment the present invention provides the tissue product of any one of the first through sixth embodiments having a GMT from about 800 to about 1,200 g/3" and a Stiffness Index from about 4.0 to about 6.0.

In an eighth embodiment the present invention provides the tissue product of any one of the first through seventh embodiments wherein the tissue product comprises from about 10 to about 50 percent, by weight of the product, high-coarseness fiber.

In a ninth embodiment the present invention provides the tissue product of any one of the first through eighth embodiments wherein the high-coarseness fiber has a coarseness greater than about 20 mg/100 m and an average fiber length greater than about 2.0 mm.

In a tenth embodiment the present invention provides the tissue product of any one of the first through ninth embodiments wherein the tissue product has a GM TEA greater than about 7.0 g*cm/cm$^2$.

In a eleventh embodiment the present invention provides the tissue product of the first through tenth embodiments wherein the product has a GM Stretch greater than about 12.0 percent.

In a twelfth embodiment the present invention provides the tissue product of any one of the first through eleventh embodiments wherein the product has a GM Slope less than about 10.0 kg, such as from about 4.0 to about 10.0 kg.

In a thirteenth embodiment the present invention provides the tissue product of any one of the first through twelfth embodiments wherein the product has a GM Tear greater than about 10 N, such as tom about 10 to about 22 N.

In a fourteenth embodiment the present invention provides the tissue product of any one of the first through thirteenth embodiments wherein the tissue product has a TS7 value is equal to or less than 0.0043*GMT+6.6367, where GMT has units of grams per three inches, and a GMT from about 700 to about 1,100 g/3".

In a fifteenth embodiment the present invention provides the tissue product of any one of the first through fourteenth embodiments wherein the product has a TS7 value less than about 10 and a GMT Tear from about 12 to about 18 N.

In a sixteenth embodiment the present invention provides a tissue product comprising at least one multi-layered tissue web comprising at least about 10 weight percent high coarseness fibers, from about 1.0 to about 10.0 weight percent synthetic fibers and less than about 10 weight percent long, low-coarseness cellulosic fibers, the tissue product having a TS7 less than about 11.0 and a GMT from about 500 to about 1,200 g/3". Preferably the at least one multi-layered tissue web is a wet-laid tissue web.

In a seventeenth embodiment the present invention provides the tissue product of the sixteenth embodiment wherein the synthetic fiber is selectively disposed in the middle layer and the two outer layers are substantially free from synthetic fiber.

In an eighteenth embodiment the present invention provides the tissue product of the sixteenth or seventeenth embodiments wherein the multi-layered web comprises from about 1.0 to about 5.0 weight percent synthetic fibers and from about 0 to about 10 weight percent long, low-coarseness cellulosic fibers, In a nineteenth embodiment the present invention provides the tissue product of any one of the sixteenth through eighteenth embodiments wherein the synthetic fiber has at least one cross-section dimension less than about 20 microns and an average fiber length from about 1.0 to about 6.0 mm.

In a twentieth embodiment the present invention provides the tissue product of any one of the sixteenth through nineteenth embodiments wherein the tissue product has a GM TEA greater than about 7.0 g*cm/cm$^2$.

In a twenty-first embodiment the present invention provides the tissue product any one of the sixteenth through twentieth embodiments wherein the tissue product has a GM Stretch greater than about 12.0 percent.

In a twenty-second embodiment the present invention provides the tissue product any one of the sixteenth through twenty-first embodiments wherein the tissue product has a GM Slope less than about 10.0 kg, such as from about 4.0 to about 10.0 kg.

In a twenty-third embodiment the present invention provides the tissue product any one of the sixteenth through twenty-second embodiments wherein the tissue product has a GM Tear greater than about 10 N, such as from about 10 to about 22 N.

In a twenty-fourth embodiment the present invention provides the tissue product any one of the sixteenth through twenty-third embodiments wherein the tissue product has a TS7 value from about 8.0 to about 10.0.

In a twenty-fifth embodiment the present invention provides the tissue product any one of the sixteenth through twenty-fourth embodiments wherein the tissue product has a TS7 value less than about 10 and a GMT Tear from about 12 to about 18.

What is claimed is:

1. A tissue product comprising at least one multi-layered tissue web having a first outer layer, a middle layer and a second outer layer, the web comprising at least about 10 weight percent high coarseness cellulosic fibers, from about 1.0 to about 10 weight percent non-cellulosic synthetic fibers selected from the group consisting of polyesters, polyalkylenes, polyacrylonitriles, and polyamides and less than about 10 weight percent long, low-coarseness cellulosic fibers, wherein the synthetic fiber is selectively disposed in the middle layer and the two outer layers are substantially free from non-cellulosic synthetic fiber, the tissue product having a TS7 less than about 11.0 and a GMT from about 500 to about 1,200 g/3".

2. The tissue product of claim 1 wherein the at least one multi-layered tissue web is substantially free from long, low coarseness, cellulosic fibers.

3. The tissue product of claim 1 wherein the at least one multi-layered tissue web comprises from about 1.0 to about 5.0 weight percent non-cellulosic synthetic fiber.

4. The tissue product of claim 1 wherein the non-cellulosic synthetic fiber is a non-fibrillated polyethylene terephthalate (PET) fiber having a substantially circular cross section and a diameter from about 0.5 to about 10 microns.

5. The tissue product of claim 1 wherein the non-cellulosic synthetic fiber has a substantially circular cross section and a diameter from about 0.5 to about 10 microns.

6. The tissue product of claim 1 wherein the high coarseness cellulosic fiber has a coarseness from 17 to about 23 mg/100 m and is derived from *P. taeda, P. elliotti, P. palustris, P. pungens, P. rigida, P. serotina, P. muricata or P. radiate.*

7. The tissue product of claim 1 wherein the tissue product is substantially free from long, low-coarseness cellulosic fibers.

8. The tissue product of claim 1 wherein the tissue product comprises from about 1.0 to about 5.0 percent non-cellulosic synthetic fibers, by weight of the tissue product.

9. The tissue product of claim 1 having a GMT from about 700 to about 1,200 g/3" and a GM Slope from about 5.0 to about 8.0 kg.

10. The tissue product of claim 1 wherein the product comprises from about 10 to about 50 weight percent high-coarseness cellulosic fiber.

11. The tissue product of claim 1 wherein the high-coarseness cellulosic fiber has a coarseness greater than 20 mg/100 m and an average fiber length greater than about 2.0 mm.

12. The tissue product of claim 1 wherein the tissue product has a GM TEA greater than about 7.0 g*cm/cm$^2$.

13. The tissue product of claim 1 wherein the tissue product has a GM Stretch greater than about 12 percent.

14. The tissue product of claim 1 wherein the tissue product has a GM Slope less than about 10.0 kg.

15. The tissue product of claim 1 wherein the tissue product has a GM Tear greater than about 10 N.

16. The tissue product of claim 1 wherein the tissue product has a TS7 value from about 8.0 to about 10.0.

17. The tissue product of claim 1 wherein the tissue product has a TS7 value equal to or less than 0.0042* GMT +6.6367, where GMT has units of grams per three inches, and a GMT from about 700 to about 1,100 g/3".

* * * * *